US009488078B2

(12) United States Patent
Douglas

(10) Patent No.: US 9,488,078 B2
(45) Date of Patent: Nov. 8, 2016

(54) VALVE LIFT CONTROL SYSTEMS AND METHODS FOR ENGINE STARTABILITY

(71) Applicant: GM Global Technology Operations LLC, Detroit, MI (US)

(72) Inventor: Scot A. Douglas, Howell, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 120 days.

(21) Appl. No.: 14/487,599

(22) Filed: Sep. 16, 2014

(65) Prior Publication Data

US 2015/0377090 A1 Dec. 31, 2015

Related U.S. Application Data

(60) Provisional application No. 62/017,901, filed on Jun. 27, 2014.

(51) Int. Cl.

| | |
|---|---|
| ***F01L 1/34*** | (2006.01) |
| ***F01L 9/04*** | (2006.01) |
| ***F01L 1/04*** | (2006.01) |
| ***F01L 1/344*** | (2006.01) |
| ***F02N 19/00*** | (2010.01) |
| *F02D 41/06* | (2006.01) |
| *F02D 41/00* | (2006.01) |

(52) U.S. Cl.

CPC .. *F01L 9/04* (2013.01); *F01L 1/04* (2013.01); *F01L 1/344* (2013.01); *F02N 19/004* (2013.01); *F02D 41/064* (2013.01); *F02D 2041/001* (2013.01); *F02N 2200/023* (2013.01)

(58) Field of Classification Search

CPC ..... F01L 1/04; F01L 1/344; F01L 9/04; F02D 41/064; F02D 2041/001; F02N 19/004; F02N 2200/023

USPC ..... 123/90.15, 90.16, 90.17

See application file for complete search history.

(56) References Cited

U.S. PATENT DOCUMENTS 6,401,675 B1 * 6/2002 Nakamura ..... F02D 41/221 123/90.15

7,308,872 B2 * 12/2007 Sellnau ..... F01L 13/0036 123/90.16

* cited by examiner

*Primary Examiner* — Ching Chang

(57) ABSTRACT

A startup/shutdown control module selectively generates an engine startup command when an engine of the vehicle is off. A starter control module applies power to a starter motor when the engine startup command is generated. A valve control module, in response to the generation of the engine startup command: operates intake valves of cylinders of the engine in a low lift mode when an engine temperature is less than a predetermined temperature; and operates the intake valves of the cylinders of the engine in a high lift mode when the engine temperature is greater than the predetermined temperature.

20 Claims, 4 Drawing Sheets

VALVE LIFT CONTROL SYSTEMS AND METHODS FOR ENGINE STARTABILITY

CROSS-REFERENCE TO RELATED APPLICATIONS

This application claims the benefit of U.S. Provisional Application No. 62/017,901, filed on Jun. 27, 2014. The disclosure of the above application is incorporated herein by reference in its entirety.

FIELD

The present disclosure relates to internal combustion engines of vehicles and more particularly to variable valve lift control systems and methods.

BACKGROUND

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Vehicles include an internal combustion engine that generates drive torque. More specifically, an intake valve is selectively opened to draw air into a cylinder of the engine. The air mixes with fuel to form an air/fuel mixture that is combusted within the cylinder. The air/fuel mixture is compressed and combusted to drive a piston within the cylinder. An exhaust valve selectively opens to allow the exhaust gas resulting from combustion to exit the cylinder.

A rotating camshaft regulates the opening and closing of the intake and/or exhaust valves. The camshaft includes cam lobes that are fixed to and rotate with the camshaft. The geometric profile of a cam lobe generally controls the period that the valve is open (duration) and the magnitude or degree to which the valve opens (lift).

Variable valve actuation (VVA), also called variable valve lift (VVL) improves fuel economy, engine efficiency, and/or performance by modifying valve lift and duration. Two-step WA systems include VVL mechanisms, such as switchable roller finger followers (SRFFs). A SRFF associated with a valve (e.g., an intake or an exhaust valve) allows the valve to be lifted in two discrete modes: a low lift mode and a high lift mode.

An engine control module (ECM) controls the torque output of the engine. For example only, the ECM controls the torque output of the engine based on driver inputs and/or other inputs. The driver inputs may include, for example, an accelerator pedal position, a brake pedal position, inputs to a cruise control system, and/or other driver inputs. The other inputs may include inputs from various vehicle systems, such as a transmission control system.

A vehicle may include an auto-start/stop system that increases the vehicle's fuel efficiency. The auto-start/stop system increases fuel efficiency by selectively shutting down the engine while the vehicle is running. While the engine is shut down, the auto-stop/start system selectively starts up the engine when one or more engine start-up conditions are satisfied.

SUMMARY

In a feature, an engine control system for a vehicle is disclosed. A startup/shutdown control module selectively generates an engine startup command when an engine of the vehicle is off. A starter control module applies power to a starter motor when the engine startup command is generated. A valve control module, in response to the generation of the engine startup command: operates intake valves of cylinders of the engine in a low lift mode when an engine temperature is less than a predetermined temperature; and operates the intake valves of the cylinders of the engine in a high lift mode when the engine temperature is greater than the predetermined temperature.

In further features, the low lift mode corresponds to a first effective compression ratio, and the high lift mode corresponds to a second effective compression ratio that is less than the first effective compression ratio.

In further features, in response to the generation of the engine startup command, the valve control module: engages a first set of intake cam lobes with the intake valves when the engine temperature is less than the predetermined temperature, wherein the first set of intake cam lobes correspond to the first effective compression ratio; and engages a second set of intake cam lobes with the intake valves when the engine temperature is greater than the predetermined temperature, wherein the second set of intake cam lobes correspond to the second effective compression ratio.

In further features, the startup/shutdown control module generates the engine startup command in response to user input to an ignition system.

In further features, the startup/shutdown control module shuts down the engine when a driver applies pressure to a brake pedal of the vehicle and generates the engine startup command when the driver removes pressure from the brake pedal.

In further features, in response to the generation of the engine startup command, the valve control module transitions operation of the intake valves from the high lift mode to the low lift mode when the engine temperature is less than the predetermined temperature.

In further features, in response to the generation of the engine startup command, the valve control module transitions operation of the intake valves from the low lift mode to the high lift mode when the engine temperature is greater than the predetermined temperature.

In further features, the valve control module determines the engine temperature based on an engine coolant temperature measured using an engine coolant temperature sensor.

In further features, the valve control module determines the engine temperature based on a period since a last shutdown of the engine.

In further features: during operation in the low lift mode, the intake valves are opened at a first time, closed at a second time, and actuated a first distance; and during operation in the high lift mode, the intake valves are opened at a third time that is before the first time, closed at a fourth time that is after the second time, and actuated a second distance that is greater than the first distance.

In a feature, an engine control method for a vehicle is disclosed. The engine control method includes: selectively generating an engine startup command when an engine of the vehicle is off; applying power to a starter motor when the engine startup command is generated; and, in response to the generation of the engine startup command: operating intake valves of cylinders of the engine in a low lift mode when an engine temperature is less than a predetermined temperature; and operating the intake valves of the cylinders of the engine in a high lift mode when the engine temperature is greater than the predetermined temperature.

In further features: the low lift mode corresponds to a first effective compression ratio; and the high lift mode corresponds to a second effective compression ratio that is less than the first effective compression ratio.

In further features, the engine control method further includes, in response to the generation of the engine startup command: engaging a first set of intake cam lobes with the intake valves when the engine temperature is less than the predetermined temperature, wherein the first set of intake cam lobes correspond to the first effective compression ratio; and engaging a second set of intake cam lobes with the intake valves when the engine temperature is greater than the predetermined temperature, wherein the second set of intake cam lobes correspond to the second effective compression ratio.

In further features, the engine control method further includes generating the engine startup command in response to user input to an ignition system.

In further features, the engine control method further includes: shutting down the engine when a driver applies pressure to a brake pedal of the vehicle; and generating the engine startup command when the driver removes pressure from the brake pedal.

In further features, the engine control method further includes, in response to the generation of the engine startup command, transitioning operation of the intake valves from the high lift mode to the low lift mode when the engine temperature is less than the predetermined temperature.

In further features, the engine control method further includes, in response to the generation of the engine startup command, transitioning operation of the intake valves from the low lift mode to the high lift mode when the engine temperature is greater than the predetermined temperature.

In further features, the engine control method further includes determining the engine temperature based on an engine coolant temperature measured using an engine coolant temperature sensor.

In further features, the engine control method further includes determining the engine temperature based on a period since a last shutdown of the engine.

In further features: during operation in the low lift mode, the intake valves are opened at a first time, closed at a second time, and actuated a first distance; and during operation in the high lift mode, the intake valves are opened at a third time that is before the first time, closed at a fourth time that is after the second time, and actuated a second distance that is greater than the first distance.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

An engine control module controls engine actuators based on a requested amount of torque. Engine actuators may include, for example, a throttle valve, a fuel system, an ignition system, camshaft phasers, a variable valve lift (VVL) system, and other types of engine actuators. A VVL mechanism of the VVL system controls actuation of a valve of an engine, such as an intake valve.

The ECM may command operation of the VVL system in a low lift mode or in a high lift mode. When operating in the low lift mode, the VVL system controls opening and closing of the valves based on a geometric profile of low lift cam lobes that rotate with a camshaft. When operating in the high lift mode, the VVL system controls opening and closing of the valves based on a geometric profile of high lift cam lobes that rotate with the camshaft. Operation in the low lift mode provides a higher effective compression ratio than operation in the high lift mode.

According to the present disclosure, the ECM sets the lift mode at engine shutdown based on whether the engine shutdown was a driver initiated engine shutdown or an engine shutdown for an auto-stop/start event. The ECM sets the lift mode to the high lift mode when the engine is shutdown for an auto-stop/start event. The ECM sets the lift mode to the low lift mode when a driver initiated engine shutdown is performed.

When the engine is later restarted, the ECM sets the lift mode based on a temperature of the engine. The ECM sets the lift mode to the low lift mode when the engine temperature is less than a predetermined temperature and sets the lift mode to the high lift mode when the engine temperature is greater than the predetermined temperature. The higher effective compression ratio during operation in the low lift mode may help injected fuel vaporize to a greater extent when the engine temperature is less than the predetermined temperature. The lower effective compression ratio during operation in the high lift mode may minimize or prevent auto-ignition, engine flare, and noise and vibration when the engine temperature is greater than the predetermined temperature.

Figure 1A:
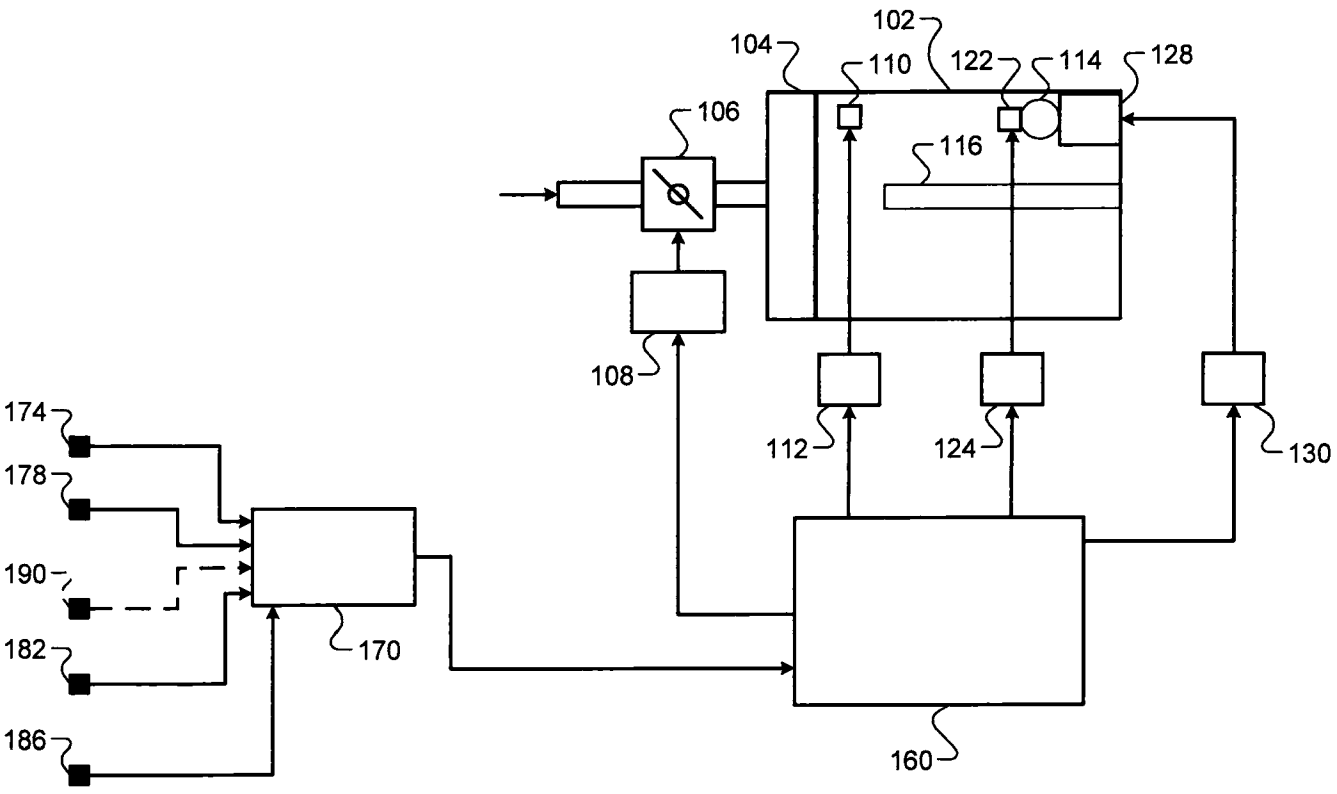
FIG. 1A is a functional block diagram of an example control system.

Referring now to FIG. 1A, a functional block diagram of an example engine control system is presented. An engine 102 generates drive torque for a vehicle. Air is drawn into the engine 102 through an intake manifold 104. Airflow into the intake manifold 104 may be varied by a throttle valve 106. A throttle actuator module 108 (e.g., an electronic throttle controller) controls opening of the throttle valve 106. One or more fuel injectors, such as fuel injector 110, mix fuel with the air to form a combustible air/fuel mixture. A fuel actuator module 112 controls the fuel injector(s).

A cylinder 114 includes a piston (not shown) that is coupled to a crankshaft 116. Although the engine 102 is depicted as including only the cylinder 114, the engine 102 may include more than one cylinder. One combustion cycle of the cylinder 114 may include four strokes: an intake stroke, a compression stroke, an expansion stroke, and an exhaust stroke. One engine cycle includes each of the cylinders undergoing one combustion cycle. While a four-stroke combustion cycle is provided as an example, another suitable operating cycle may be used.

Figure 1B:
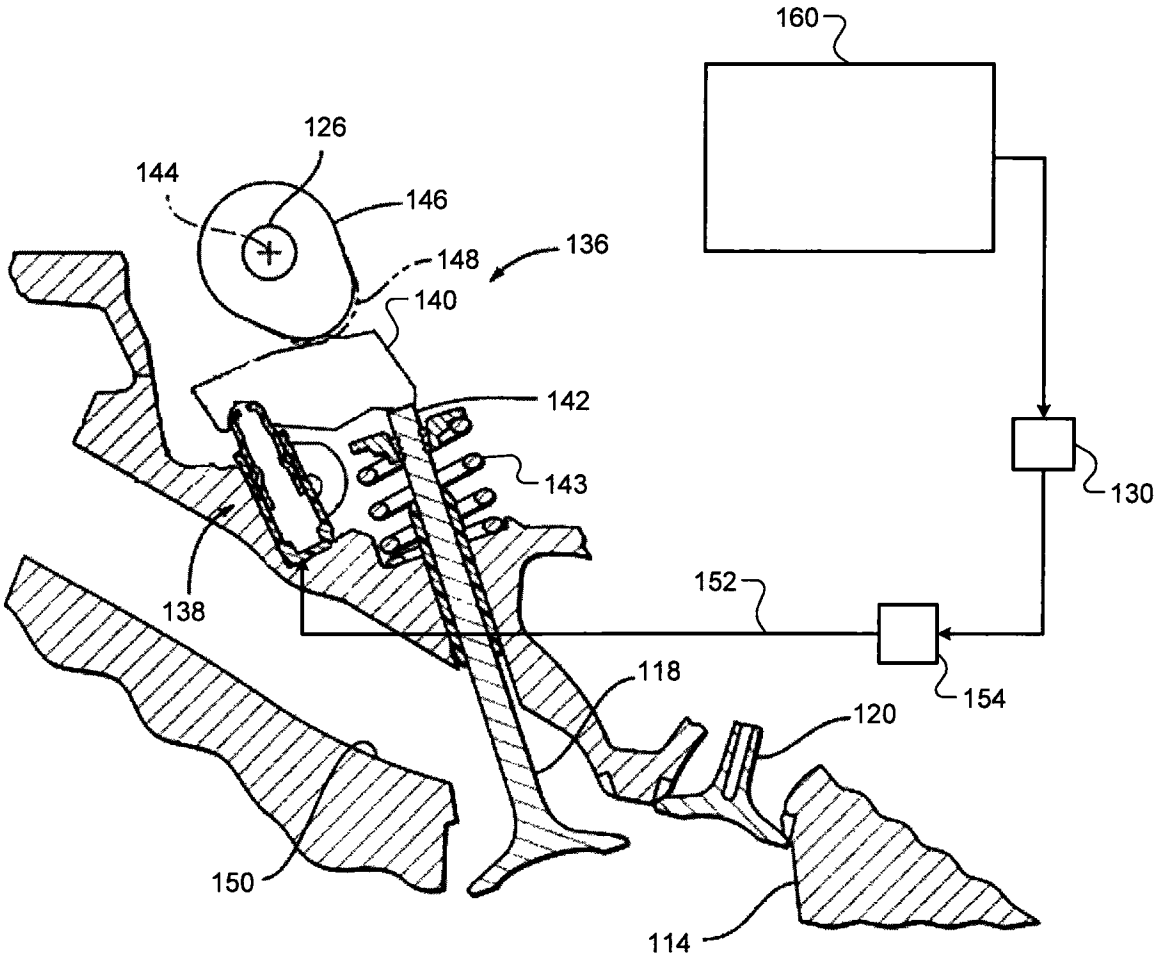
FIG. 1B is a diagram of an example variable valve lift (VVL) system.

FIG. 1B is a diagram including an example variable valve lift (VVL) system. Referring now to FIGS. 1A and 1B, during the intake stroke, the piston is lowered to a bottom most position, and air and fuel may be provided to the cylinder 114. The bottom most position may be referred to as a bottom dead center (BDC) position. Air enters the cylinder 114 through one or more intake valves, such as intake valve 118. One or more exhaust valves, such as exhaust valve 120, are also associated with the cylinder 114. For purposes of discussion only, only the intake valve 118 and the exhaust valve 120 will be discussed.

During the compression stroke, the crankshaft 116 drives the piston toward a top most position. The intake valve 118 and the exhaust valve 120 may both be closed during the compression stroke, and the piston compresses the air/fuel mixture within the cylinder 114. The top most position may be referred to as a top dead center (TDC) position. A spark plug 122 may ignite the air/fuel mixture in various types of engines. A spark actuator module 124 controls the spark plug 122.

Combustion of the air/fuel mixture drives the piston back toward the BDC position during the expansion stroke, thereby rotatably driving the crankshaft 116. The rotational force may be a source of compressive force for a compression stroke of a combustion cycle of a next cylinder in a predetermined firing order. Exhaust resulting from the combustion of the air/fuel mixture is expelled from the cylinder 114 during the exhaust stroke. The exhaust is expelled from the cylinder 114 via the exhaust valve 120.

The timing of opening and closing of the intake valve 118 is regulated by an intake camshaft 126. An intake camshaft, such as the intake camshaft 126, may be provided for each bank of cylinders of the engine 102. The timing of opening and closing of the exhaust valve 120 is regulated by an exhaust camshaft (not shown). An exhaust camshaft may be provided for each bank of cylinders of the engine 102. Rotation of the intake camshaft(s) and the exhaust camshaft (s) is generally driven by rotation of the crankshaft 116, such as by a belt or a chain. In various implementations, one camshaft may control both intake and exhaust valves.

A cam phaser regulates rotation of an associated camshaft. For example only, intake cam phaser 128 (FIG. 1A) may regulate rotation of the intake camshaft 126 (FIG. 1B). The intake cam phaser 128 may adjust the rotation of the intake camshaft 126, for example, with respect to rotation of the crankshaft 116. For example only, the intake cam phaser 128 may retard or advance rotation of the intake camshaft 126, thereby changing the opening and closing timing of the intake valve 118. While not shown, an exhaust cam phaser may regulate rotation of the exhaust camshaft. Adjusting the rotation of a camshaft with respect to rotation of the crankshaft 116 may be referred to as camshaft phasing.

A phaser actuator module 130 controls the intake cam phaser 128. The phaser actuator module 130 or another phaser actuator module may control operation of other cam phasers. The intake cam phaser 128 may be, for example, electrically or hydraulically actuated. A hydraulically actuated cam phaser actuates based on pressure of a hydraulic fluid (e.g., oil) supplied to the cam phaser.

A variable valve lift (VVL) mechanism 136 (FIG. 1B) controls actuation of the intake valve 118. For example only, the VVL mechanism 136 may include a switchable roller finger follower (SRFF) mechanism. While the VVL mechanism 136 is shown and will be discussed as a SRFF, the VVL mechanism 136 may include other types of valve lift mechanisms that enable an associated valve to be lifted to two or more discrete lift positions. Further, while the VVL mechanism 136 is shown and will be discussed as being associated with the intake valve 118, the VVL mechanism 136 or another VVL mechanism may be implemented similarly for the exhaust valve 120. For example only, one VVL mechanism may be provided for each intake valve and one VVL mechanism may be provided for each exhaust valve of a cylinder.

The VVL mechanism 136 includes a lift adjuster 138 and a cam follower 140. The cam follower 140 is in mechanical contact with a valve stem 142 of the intake valve 118. A biasing device 143 biases the valve stem 142 into contact with the cam follower 140. The cam follower 140 is also in mechanical contact with the intake camshaft 126 and the lift adjuster 138.

The intake camshaft 126 rotates about a camshaft axis 144. The intake camshaft 126 includes a plurality of cam lobes including low lift cam lobes, such as low lift cam lobe 146, and high lift cam lobes, such as high lift cam lobe 148. For example only, the intake camshaft 126 may include one low lift cam lobe and one high lift cam lobe for each intake valve of a cylinder. The intake camshaft 126 may also include one additional cam lobe (not shown) for each intake valve of a cylinder for operation in a cylinder deactivation mode. The intake and exhaust valves of one or more cylinders, such as half of the cylinders of the engine 102, are deactivated during operation in the cylinder deactivation mode.

The low and high lift cam lobes 146 and 148 rotate with the intake camshaft 126. Air may flow into the cylinder 114 through an inlet passage 150 when the intake valve 118 is open. Airflow into the cylinder 114 may be blocked when the intake valve 118 is closed. The intake valve 118 is selectively lifted (i.e., opened) and lowered (i.e., closed) via the intake camshaft 126. More specifically, the intake valve 118 is opened and closed by the low lift cam lobe 146 or the high lift cam lobe 148.

A cam lobe contacting the cam follower 140 applies a force to the cam follower 140 in the direction of the valve stem 142 and the lift adjuster 138. The lift adjuster 138 is collapsible and allows the intake valve 118 to be opened to two different positions, a low lift position and a high lift position. The extent to which the lift adjuster 138 is collapsible is based on pressure of a hydraulic fluid 152 provided to the lift adjuster 138. Generally, the extent to which the lift adjuster 138 is collapsible decreases as the pressure of the hydraulic fluid 152 increases and vice versa. As the collapsibility of the lift adjuster 138 decreases, the cam follower 140 applies more of the force of a cam lobe to the valve stem 142, thereby opening the intake valve 118 to a greater extent and vice versa.

The hydraulic fluid 152 may be provided to the lift adjuster 138 at a predetermined low lift pressure and at a predetermined high lift pressure to regulate opening of the intake valve 118 in a low lift mode and a high lift mode, respectively. The predetermined high lift pressure is greater than the predetermined low lift pressure. A fluid control valve 154 regulates the flow of the hydraulic fluid 152 to the lift adjuster 138. The phaser actuator module 130 may control the fluid control valve 154. The fluid control valve 154 may also be referred to as an oil control valve (OCV).

To summarize, during operation in the low lift mode, the low lift cam lobe 146 causes the VVL mechanism 136 to pivot in accordance with the geometry of the low lift cam lobe 146. The pivoting of the VVL mechanism 136 caused by the low lift cam lobe 146 opens the intake valve 118 a first predetermined amount. During operation in the high lift mode, the high lift cam lobe 148 causes the VVL mechanism 136 to pivot in accordance with the geometry of the high lift cam lobe 148. The pivoting of the VVL mechanism 136 caused by the high lift cam lobe 148 opens the intake valve 118 a second predetermined amount. The second predetermined amount is greater than the first predetermined amount. The period (duration) that the intake valve 118 is open when the high lift cam lobe 148 is used may be greater than the period that the intake valve 118 is open when the low lift cam lobe 146 is used. More specifically, the low lift cam lobe 146 may provide a later intake valve opening and an earlier intake valve closing than the high lift cam lobe 148. While an example hydraulic VVL system has been described, the present disclosure is also applicable to other types VVL systems, such VVL systems including electromechanical VVL mechanisms and other types of VVL mechanisms.

An engine control module (ECM) 160 regulates operation of the engine 102 to achieve a requested amount of torque. For example, the ECM 160 may regulate opening of the throttle valve 106, amount and timing of fuel injection, spark timing, camshaft phasing, lift mode, and other engine operating parameters based on the requested amount of torque.

The ECM 160 may control the torque output of the engine 102 based on, for example, driver inputs and inputs from various vehicle systems. The vehicle systems may include, for example, a transmission system, a hybrid control system, a stability control system, a chassis control system, and other suitable vehicle systems.

A driver input module 170 provides the driver inputs to the ECM 160. The driver inputs may include, for example, an accelerator pedal position (APP), a brake pedal position (BPP), cruise control inputs, and vehicle operation commands. An APP sensor 174 measures position of an accelerator pedal (not shown) and generates the APP based on the position. A BPP sensor 178 monitors actuation of a brake pedal (not shown) and generates the BPP accordingly. A cruise control system 182 provides the cruise control inputs, such as a desired vehicle speed, based on inputs to the cruise control system 182.

The vehicle operation commands may include, for example, vehicle startup commands and vehicle shutdown commands. The vehicle operation commands may be made via actuation of, for example, an ignition key, one or more buttons/switches, and/or one or more suitable ignition input device, such as ignition input device 186.

In vehicles having a manual transmission, the driver inputs provided to the ECM 160 may also include a clutch pedal position (CPP). A CPP sensor 190 monitors actuation of a clutch pedal (not shown) and generates the CPP accordingly. The clutch pedal may be actuated to couple a transmission to the engine 102 and de-couple the transmission from the engine 102. While the APP sensor 174, the BPP sensor 178, and the CPP sensor 190 are shown and described, one or more additional APP, BPP, and/or CPP sensors may be provided.

The ECM 160 selectively shuts down the engine 102 when a vehicle shutdown command is received. For example only, the ECM 160 may disable the injection of fuel, disable the provision of spark, operate the intake valves in the low lift mode, and perform other engine shutdown operations to shut down the engine 102 when a vehicle shutdown command is received. A starter motor (not shown) cranks the engine 102 to start the engine 102 when a vehicle startup command is received.

Other than commanded vehicle startups and vehicle shutdowns, the ECM 160 may selectively perform auto-stop events and auto-start events of the engine 102. An auto-stop event includes shutting down the engine 102 when one or more predetermined enabling criteria are satisfied when vehicle shutdown has not been commanded (e.g., while the ignition system is in an ON state). During an auto-stop event, the ECM 160 shuts down the engine 102 and the provision of fuel to the engine 102 may be disabled, for example, to increase fuel economy (by decreasing fuel consumption).

While the engine 102 is shut down for an auto-stop event, the ECM 160 may selectively perform an auto-start event. An auto-start event may include, for example, enabling fueling, enabling the provision of spark, engaging the starter motor with the engine 102, and applying current to the starter motor to start the engine 102.

The VVL system, via the ability to change lift and duration of intake valve opening events, provides different effective compression ratios. For example, operation in the high lift mode provides a lower effective compression ratio than operation in the low lift mode. Written conversely, operation in the low lift mode provides a higher effective compression ratio than operation in the high lift mode.

Different types of fuel and different operating conditions may benefit from different effective compression ratios at engine startup depending on the operating conditions. Effective compression ratio is directly proportional to heat energy available to evaporate fuel within the combustion chamber. The combination of the engine 102 being hot and a high effective compression ratio when an engine startup is performed may cause pre-ignition and an engine speed flare may occur. Engine speed flare may refer to the extent that an engine speed overshoots a predetermined idle speed for an engine startup. A fuel may insufficiently vaporize when the engine 102 is cold and a low effective compression ratio is used at engine startup.

According to the present disclosure, the ECM 160 controls the lift mode based on an engine temperature when an engine startup is performed, such as for a vehicle startup event or an auto-start event. The ECM 160 operates the VVL system in the low lift mode, thereby providing a higher effective compression ratio, when the engine temperature is less than a first predetermined temperature at engine startup. The higher effective compression ratio may enable the fuel to vaporize to a greater extent during engine startup. When the engine temperature is greater than a second predetermined temperature at engine startup, the ECM operates the VVL system in the high lift mode, thereby providing a lower effective compression ratio. The lower effective compression may help prevent pre-ignition and minimize or prevent engine flare.

Figure 2:
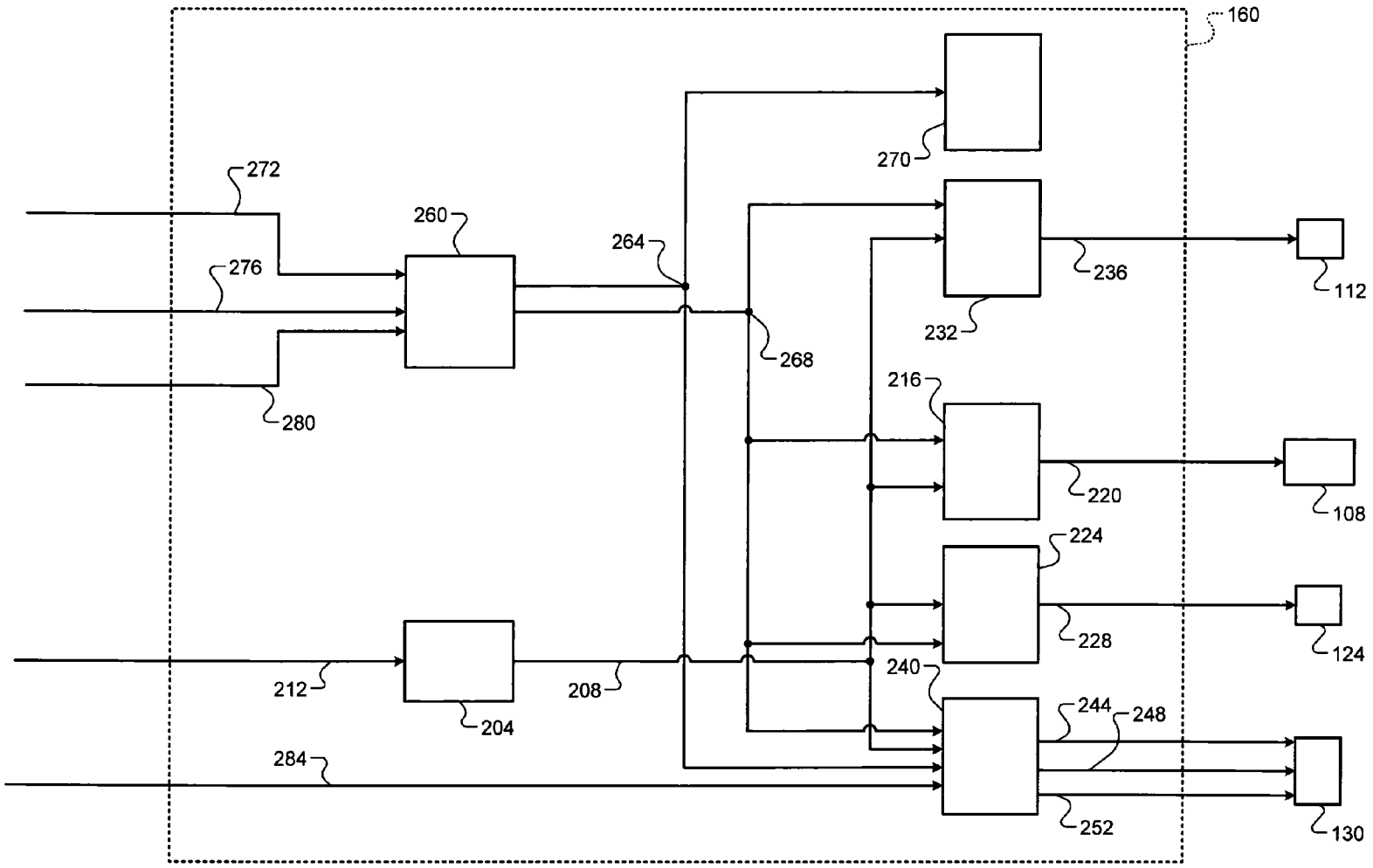
FIG. 2 is a functional block diagram of an example engine control module.

Referring now to FIG. 2, a functional block diagram of an example engine control system including an example implementation of the ECM 160 is presented. A torque request module 204 may determine a torque request 208 based on one or more driver inputs 212, such as an accelerator pedal position, a brake pedal position, a cruise control input, and/or one or more other suitable driver inputs. The torque request module 204 may determine the torque request 208 additionally or alternatively based on one or more other torque requests, such as torque requests generated by the ECM 160 and/or torque requests received from other modules of the vehicle, such as a transmission control module, a hybrid control module, a chassis control module, etc.

One or more engine actuators may be controlled based on the torque request 208 and/or one or more other parameters. For example, a throttle control module 216 determines a target throttle opening 220 based on the torque request 208. The throttle actuator module 108 controls opening of the throttle valve 106 based on the target throttle opening 220.

A spark control module 224 determines a target spark timing 228 based on the torque request 208. The spark actuator module 124 generates spark based on the target spark timing 228. A fuel control module 232 determines one or more target fueling parameters 236 based on the torque request 208. For example, the target fueling parameters 236 may include fuel injection amount, number of fuel injections for injecting the amount, and timing for each of the injections. The fuel actuator module 112 injects fuel based on the target fueling parameters 236.

A valve control module 240 may determine target intake and exhaust cam phaser angles 244 and 248 based on the torque request 208. The phaser actuator module 130 controls the intake cam phaser 128 and the exhaust cam phaser based on the target intake and exhaust cam phaser angles 244 and 248, respectively. One or more other engine actuators may be controlled based on the torque request 308.

The valve control module 240 also determines a target lift mode 252. Based on the target lift mode 252, the phaser actuator module 130 controls the VVL system to operate the intake valves in the target lift mode 252. For example, the phaser actuator module 130 controls the VVL system to operate the intake valves in the low lift mode when the target lift mode 252 indicates the low lift mode. The phaser actuator module 130 controls the VVL system to operate the intake valves in the high lift mode when the target lift mode 252 indicates the high lift mode. The phaser actuator module 130 controls the VVL system to deactivate intake valves when the target lift mode 252 is the cylinder deactivation mode.

A startup/shutdown control module 260 controls startup and shutdown of the engine 102. The startup/shutdown control module 260 generates an engine startup command 264 when a vehicle startup command is input by a driver via the ignition input device 186, such as an ignition button, key, etc. A starter control module 270 engages a starter and applies power to the starter to crank the engine 102 when the engine startup command 264 is generated. The fuel control module 232 and the spark control module 224 begin to provide fuel and spark, respectively, to the engine 102 after the engine startup command 264 is generated.

The startup/shutdown control module 260 generates an engine shutdown command 268 when a vehicle shutdown command is input by a driver via the ignition input device 186. The fuel control module 232 stops providing fuel to the engine 102 to shut down the engine 102 when the engine shutdown command 268 is generated. The spark control module 224 may stop generating spark when the engine shutdown command 268 is generated. Vehicle startup and shutdown commands may be indicated via a vehicle operation signal 272. For example only, the vehicle operation signal 272 may be set to a first state for a vehicle startup command and may be set to a second state for a vehicle shutdown command.

The startup/shutdown control module 260 also generates the engine shutdown command 268 to perform an auto-stop event. For example, the startup/shutdown control module 260 perform an auto-stop event when a vehicle speed 276 is less than a predetermined speed (or stopped) and the driver is depressing the brake pedal. Depression of the brake pedal may be indicated by a brake pedal position (BPP) 280, for example, measured using a BPP sensor. The vehicle speed 276 may be measured using a sensor or determined based on one or more other parameters, such as one or more wheel speeds measured using wheel speed sensors. The valve control module 240 set the target lift mode 252 to the high lift mode when the engine shutdown command 268 is generated for an auto-stop event. This may provide a better startup when the engine 102 is next started for an auto-start event. The valve control module 240 sets the target lift mode 252 to the low lift mode when the engine shutdown command 268 is generated when a vehicle shutdown command is input by a driver.

Auto-stop events and auto-start events are performed while the ignition system of the vehicle is ON, without the driver requesting that the engine 102 or vehicle be shut down. More specifically, auto-stop events and auto-start events are performed between a time when a driver inputs a vehicle startup command and a next time when the driver inputs a vehicle shutdown command.

The startup/shutdown control module 260 also generates the engine startup command 264 to perform an auto-start event while the engine 102 is shut down for an auto-stop event. For example, the startup/shutdown control module 260 may perform an auto-start event when the driver releases the brake pedal while the engine 102 is OFF for an auto-stop event. The release of the brake pedal may be indicated by the BPP 280. The startup/shutdown control module 260 may also perform an auto-start event, for example, when a temperature within a passenger cabin is greater than a predetermined temperature and/or when one or more other conditions are met for performing an auto-start event while the engine 102 is OFF for an auto-stop event.

Under some circumstances, a change in the lift mode used when the engine startup command 264 is generated may provide a more satisfactory engine startup. For example, the valve control module 240 may set the target lift mode 252 to the low lift mode when a vehicle shutdown command is received. However, the engine 102 will remain warm for a period of time after the engine 102 is shut down pursuant to that vehicle shutdown command. If a vehicle startup command is received while the engine 102 is still warm, a lower effective compression ratio may provide a more satisfactory engine startup. For example, the lower effective compression ratio may decrease a likelihood of auto-ignition, decrease or prevent engine flare, and/or decrease noise and/or vibration. A transition to the high lift mode may therefore provide a more satisfactory engine startup.

As another example, the engine 102 may be shutdown pursuant to an auto-stop event when the target lift mode 252 is set to the high lift mode. If a vehicle shutdown command is received while the engine 102 is OFF for the auto-stop event, the lift mode will still be the high lift mode when a vehicle startup command is next received. When the engine temperature is low when a vehicle startup command is next received, injected fuel may be unable to vaporize sufficiently. A higher effective compression ratio may enable injected fuel to vaporize to a greater extent. A transition to the low lift mode may therefore provide a more satisfactory engine startup.

The valve control module 240 stores the current target lift mode 252 when a vehicle shutdown command is received. When the engine startup command 264 is generated, the valve control module 240 obtains an engine temperature 284. The engine temperature 284 may be measured using a temperature sensor, such as an engine coolant temperature (ECT), and/or determined based on one or more other parameters. For example, the engine temperature 284 may be estimated when the engine startup command 264 is generated based on a period since the engine 102 was last shut down and/or an ambient air temperature. For example only, the valve control module 240 may determine engine temperature 284 using one or more functions and/or mappings that relate the period since the engine 102 was last shut down and ambient air temperature to engine temperature.

If the engine temperature 284 is greater than a first predetermined temperature when the engine startup command 264 is generated, the valve control module 240 sets the target lift mode 252 to the high lift mode. For example only, the first predetermined temperature may be approximately 60 degrees Celsius (° C.) or another suitable temperature. When the engine is less than the first predetermined temperature and the engine startup command 264 is generated, the valve control module 240 sets the target lift mode 252 to the low lift mode.

In various implementations, two or more predetermined temperatures may be used. For example, when the engine temperature 284 is greater than the first predetermined temperature and the engine startup command 264 is generated, the valve control module 240 sets the target lift mode 252 to the high lift mode. When the engine is less than a second predetermined temperature when the engine startup command 264 is generated, the valve control module 240 sets the target lift mode 252 to the low lift mode. The first predetermined temperature is greater than the second predetermined temperature. When the engine temperature 284 is between the first and second predetermined temperatures and the engine startup command 264 is generated, the valve control module 240 may set the target lift mode 252 to the target lift mode 252 when the engine 102 was last shut down. For example only, the second predetermined temperature may be approximately 30° C. or other suitable temperature.

Figure 3:
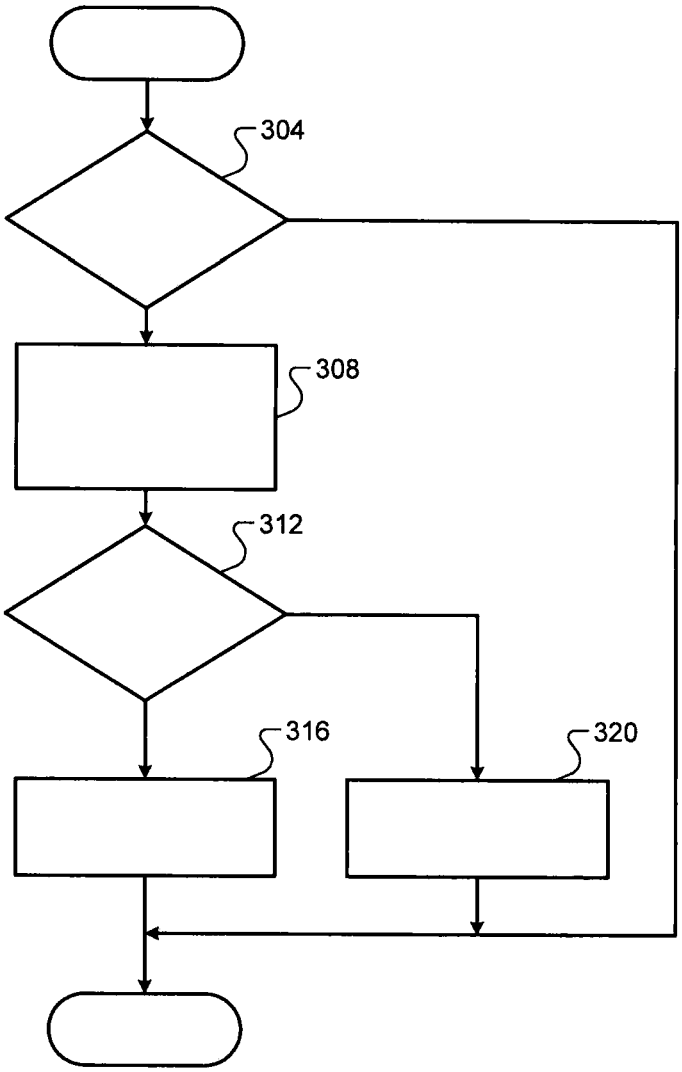
FIG. 3 is a flowchart depicting an example method of controlling valve lift.

Referring now to FIG. 3, a flowchart depicting an example method of controlling the lift mode is presented. Control begins at 304 while the engine 102 is OFF pursuant to a vehicle shutdown command or for an auto-stop event. At 304, the startup/shutdown control module 260 determines whether to generate the engine startup command 264 to start the engine 102. If 304 is true, control continues with 308. If 304 is false, control may end. For example, the startup/shutdown control module 260 may generate the engine startup command 264 when a vehicle startup command is received or when an auto-start event is to be performed.

At 308, the startup/shutdown control module 260 generates the engine startup command 264. The starter control module 270 engages and applies power to the starter motor to crank the engine 102 when the engine startup command 264 is generated. The fuel control module 232 and the spark control module 224 begin to supply fuel and spark, respectively, to cylinders of the engine while the starter motor cranks the engine 102. The valve control module 240 also obtains the engine temperature 284 at 308. The engine temperature 284 may be measured, for example, using a sensor (e.g., an ECT sensor) or determined based on one or more other parameters.

The valve control module 240 determines whether the engine temperature 284 is less than the first predetermined temperature at 312. If 312 is true, the valve control module 240 sets the target lift mode 252 to the low lift mode at 316, and control ends. When the target lift mode 252 is in the low lift mode, the phaser actuator module 130 engages the low lift cam lobes with the intake valves so the intake valves open and close according to the low lift cam lobes. If 312 is false, the valve control module 240 sets the target lift mode 252 to the high lift mode at 320, and control ends. When the target lift mode 252 is in the high lift mode, the phaser actuator module 130 engages the high lift cam lobes with the intake valves so the intake valves open and close according to the high lift cam lobes.

While control is shown and discussed as ending, the example of FIG. 3 is illustrative of one control loop and control loops may be performed at a predetermined rate. Also, while the example of FIG. 3 is shown involving only the first predetermined temperature, the second predetermined temperature may also be used to set the target lift mode 252, as discussed above.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. As used herein, the phrase at least one of A, B, and C should be construed to mean a logical (A OR B OR C), using a non-exclusive logical OR, and should not be construed to mean "at least one of A, at least one of B, and at least one of C." It should be understood that one or more steps within a method may be executed in different order (or concurrently) without altering the principles of the present disclosure.

In this application, including the definitions below, the term 'module' or the term 'controller' may be replaced with the term 'circuit.' The term 'module' may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium include nonvolatile memory circuits (such as a flash memory circuit or a mask read-only memory circuit), volatile memory circuits (such as a static random access memory circuit and a dynamic random access memory circuit), and secondary storage, such as magnetic storage (such as magnetic tape or hard disk drive) and optical storage.

The apparatuses and methods described in this application may be partially or fully implemented by a special purpose computer created by configuring a general purpose computer to execute one or more particular functions embodied in computer programs. The computer programs include processor-executable instructions that are stored on at least one non-transitory, tangible computer-readable medium. The computer programs may also include or rely on stored data. The computer programs may include a basic input/output system (BIOS) that interacts with hardware of the special purpose computer, device drivers that interact with particular devices of the special purpose computer, one or more operating systems, user applications, background services and applications, etc.

The computer programs may include: (i) assembly code; (ii) object code generated from source code by a compiler; (iii) source code for execution by an interpreter; (iv) source code for compilation and execution by a just-in-time compiler, (v) descriptive text for parsing, such as HTML (hypertext markup language) or XML (extensible markup language), etc. As examples only, source code may be written in C, C++, C#, Objective-C, Haskell, Go, SQL, Lisp, Java®, ASP, Perl, Javascript®, HTML5, Ada, ASP (active server pages), Perl, Scala, Erlang, Ruby, Flash®, Visual Basic®, Lua, or Python®.

None of the elements recited in the claims is intended to be a means-plus-function element within the meaning of 35 U.S.C. §112(f) unless an element is expressly recited using the phrase "means for", or in the case of a method claim using the phrases "operation for" or "step for".

What is claimed is:

1. An engine control system for a vehicle, comprising:

a startup/shutdown control module that selectively generates an engine startup command signal when an engine of the vehicle is off and that selectively shuts down the engine of the vehicle;

a starter control module that applies power to a starter motor when the engine startup command signal is generated; and a valve control module that:

in response to the generation of the engine startup command signal:

operates intake valves of cylinders of the engine in a low lift mode when an engine temperature is less than a predetermined temperature; and operates the intake valves of the cylinders of the engine in a high lift mode when the engine temperature is greater than the predetermined temperature;

when the startup/shutdown control module shuts down the engine in response to user input to an ignition system, operates the intake valves of the cylinders of the engine in the low lift mode; and when the startup/shutdown control module shuts down the engine in response to a driver applying pressure to a brake pedal of the vehicle, operates the intake valves of the cylinders of the engine in the high lift mode.

2. The engine control system of claim 1 wherein:

the low lift mode corresponds to a first effective compression ratio; and the high lift mode corresponds to a second effective compression ratio that is less than the first effective compression ratio.

3. The engine control system of claim 2 wherein, in response to the generation of the engine startup command signal, the valve control module:

engages a first set of intake cam lobes with the intake valves when the engine temperature is less than the predetermined temperature, wherein the first set of intake cam lobes correspond to the first effective compression ratio; and engages a second set of intake cam lobes with the intake valves when the engine temperature is greater than the predetermined temperature, wherein the second set of intake cam lobes correspond to the second effective compression ratio.

4. The engine control system of claim 1 wherein the startup/shutdown control module generates the engine startup command signal in response to user input to the ignition system.

5. The engine control system of claim 1 wherein the startup/shutdown control module generates the engine startup command signal when the driver removes pressure from the brake pedal.

6. The engine control system of claim 1 wherein, in response to the generation of the engine startup command signal, the valve control module transitions operation of the intake valves from the high lift mode to the low lift mode when the engine temperature is less than the predetermined temperature.

7. The engine control system of claim 1 wherein, in response to the generation of the engine startup command signal, the valve control module transitions operation of the intake valves from the low lift mode to the high lift mode when the engine temperature is greater than the predetermined temperature.

8. The engine control system of claim 1 wherein the valve control module determines the engine temperature based on an engine coolant temperature measured using an engine coolant temperature sensor.

9. The engine control system of claim 1 wherein the valve control module determines the engine temperature based on a period since a last shutdown of the engine.

10. The engine control system of claim 1 wherein:

during operation in the low lift mode, the intake valves are opened at a first time, closed at a second time, and actuated a first distance; and during operation in the high lift mode, the intake valves are opened at a third time that is before the first time, closed at a fourth time that is after the second time, and actuated a second distance that is greater than the first distance.

11. An engine control method for a vehicle, the engine control method comprising:

selectively generating an engine startup command signal when an engine of the vehicle is off;

applying power to a starter motor when the engine startup command signal is generated;

in response to the generation of the engine startup command signal:

operating intake valves of cylinders of the engine in a low lift mode when an engine temperature is less than a predetermined temperature; and operating the intake valves of the cylinders of the engine in a high lift mode when the engine temperature is greater than the predetermined temperature;

in response to a first shut down of the engine of the vehicle performed in response to user input to an ignition system, operating the intake valves of the cylinders of the engine in the low lift mode; and in response to a second shut down of the engine of the vehicle performed in response to a driver applying pressure to a brake pedal of the vehicle, operating the intake valves of the cylinders of the engine in the high lift mode.

12. The engine control method of claim 11 wherein:

the low lift mode corresponds to a first effective compression ratio; and the high lift mode corresponds to a second effective compression ratio that is less than the first effective compression ratio.

13. The engine control method of claim 12 further comprising, in response to the generation of the engine startup command signal:

engaging a first set of intake cam lobes with the intake valves when the engine temperature is less than the predetermined temperature, wherein the first set of intake cam lobes correspond to the first effective compression ratio; and engaging a second set of intake cam lobes with the intake valves when the engine temperature is greater than the predetermined temperature, wherein the second set of intake cam lobes correspond to the second effective compression ratio.

14. The engine control method of claim 11 further comprising generating the engine startup command signal in response to second user input to the ignition system.

15. The engine control method of claim 11 further comprising, after the second shut down of the engine, generating the engine startup command signal when the driver removes pressure from the brake pedal.

16. The engine control method of claim 11 further comprising, in response to the generation of the engine startup command signal, transitioning operation of the intake valves from the high lift mode to the low lift mode when the engine temperature is less than the predetermined temperature.

17. The engine control method of claim 11 further comprising, in response to the generation of the engine startup command signal, transitioning operation of the intake valves from the low lift mode to the high lift mode when the engine temperature is greater than the predetermined temperature.

18. The engine control method of claim 11 further comprising determining the engine temperature based on an engine coolant temperature measured using an engine coolant temperature sensor.

19. The engine control method of claim 11 further comprising determining the engine temperature based on a period since a last shut down of the engine.

20. The engine control method of claim 11 wherein:

during operation in the low lift mode, the intake valves are opened at a first time, closed at a second time, and actuated a first distance; and during operation in the high lift mode, the intake valves are opened at a third time that is before the first time, closed at a fourth time that is after the second time, and actuated a second distance that is greater than the first distance.

* * * * *